US005898273A

United States Patent [19]

Collins et al.

[11] Patent Number: 5,898,273

[45] Date of Patent: Apr. 27, 1999

[54] METAL HALIDE LAMP WITH PRE-START ARC TUBE HEATER

[75] Inventors: Byron R. Collins, Tuxedo; George E. Kiefer, Hendersonville, both of N.C.

[73] Assignee: General Electric Company, Schenectady, N.Y.

[21] Appl. No.: 08/886,302

[22] Filed: Jul. 1, 1997

[51] Int. Cl.[6] ..... H01J 17/20

[52] U.S. Cl. ..... 313/638; 313/25; 313/634

[58] Field of Search ..... 313/25, 484, 567, 313/570, 580, 594, 601, 607, 620, 634, 638; 315/344, 289, 290

[56] References Cited

U.S. PATENT DOCUMENTS

| | | | |
|---|---|---|---|
| 3,828,214 | 8/1974 | Keeffe et al. | 313/25 |
| 4,048,539 | 9/1977 | Walker et al. . | |
| 4,053,809 | 10/1977 | Fridrich et al. | 313/113 |
| 4,316,122 | 2/1982 | Yamazaki et al. | 315/74 |
| 4,739,152 | 4/1988 | Downs | 313/114 |
| 4,788,475 | 11/1988 | Jacobs | 315/183 |
| 4,975,622 | 12/1990 | Ravi | 315/56 |
| 5,047,693 | 9/1991 | Roberts et al. . | |
| 5,059,868 | 10/1991 | El-Hamamsy et al. . | |
| 5,220,237 | 6/1993 | Maseki et al. | 313/114 |

OTHER PUBLICATIONS

Block, "Lighting Handbook, Eigth Edition," The Illuminating Engineering Society of North America, New York, New York (1993), p. 219 and copyright page.

Byszewski et al., "Enhanced Starting of HID Lamps," Journal of the Illuminating Engineering Society, Summer 1990, pp. 70–75.

Cohen et al., "Heat Starting a High–Pressure Sodium Lamp," Journal of IES, Jul. 1974, pp. 330–335.

Collins et al., "HPS Lamps for use on HPM ballasts," Lighting Design and Application (Illuminating Engineering Society of North America), Sep. 1975, pp. 18–24.

Gregor et al., "Arc Tube Transparency Loss Due to Starting of HID Lamps," Journal of the Illuminating Engineering Society, Summer 1996, pp. 150–159.

Nortrup et al., "Pulse Start of Metal Halide Lamps for Improved Lumen Maintenance," Journal of the Illuminating Engineering Society, Summer 1996, pp. 113–116.

Waymouth et al., "Sodium Loss Processes in Metal Iodide Arc Lamps," Illuminating Engineering, Apr. 1967, pp. 314–220.

Wyner, "Electrolysis of sodium through alumina arc tubes," Journal of IES, Apr. 1979, pp. 166–173.

*Primary Examiner*—Vip Patel
*Attorney, Agent, or Firm*—Charles E. Bruzga, Esq.

[57] ABSTRACT

A metal halide gas discharge lamp comprises an arc tube containing a vaporizable metal halide and first and second spaced electrodes. An arrangement for heating the arc tube assists in creating an arc discharge between the first and second electrodes. It comprises a heat source positioned to heat the arc tube, and an electron barrier disposed between the heat source and the arc tube for minimizing accumulation of photoelectrons on an outer surface of the arc tube so as to substantially avoid sodium migration out of the arc tube. A switch deactivates the heat source after the arc tube is heated a desired amount.

13 Claims, 5 Drawing Sheets

METAL HALIDE LAMP WITH PRE-START ARC TUBE HEATER

FIELD OF THE INVENTION

The present invention relates to metal halide gas discharge lamps or systems, and, more particularly, to such a lamp or system incorporating a heater for heating an arc tube of the lamp prior to starting the lamp.

BACKGROUND OF THE INVENTION

Metal halide gas discharge lamps include an arc tube containing vaporizable material including metal halide and mercury, and a pair of spaced electrodes made, e.g., of tungsten. To start such a lamp, a voltage of typically several hundred volts is impressed across the electrodes with the object of creating an arc discharge from one electrode to the other. During the initial, low pressure stage of starting a metal halide lamp from normal ambient temperature (e.g., 25° C.), a high electric field gradient exists in the proximity of the electrodes. The high gradient results in ions of relatively low atomic weight, such as argon, striking the electrodes at high speed, and dislodging tungsten from the electrode, a process known as sputtering.

The dislodged particles of tungsten accumulate on, and darken, the inner wall of the arc tube, degrading the lumen maintenance of the lamp. The present inventors have considered a possible approach to reducing the amount of electrode sputtering by elevating the temperature of the arc tube before attempting to strike an arc in the tube. Increasing temperature increases the vapor pressure of vaporizable material in the arc tube. This reduces the mean free path of the ions, reducing their impact velocity at the electrodes and thereby reducing the sputtering damage. Additionally, when material with a high atomic weight, such as mercury, becomes vaporized, the ions of such material are accelerated less by the electric field gradient in relation to low atomic weight material, and thus impact the electrodes at a relatively lower velocity. This additionally reduces electrode sputtering.

The present inventors considered adding a heater to heat the arc tube and thereby increase its pressure prior to attempting to strike an arc in the tube. A problem faced by the present inventors was how to avoid short lamp life due to the so-called photoelectron effect. According to this effect, energetic photons from the arc tube impinge upon a typical, metallic heating filament, for instance, and cause the release of electrons therefrom. Such "photoelectrons" accumulate on the outer wall of the arc tube, creating a negative electric field, and induce sodium ions to migrate out of the arc tube. The loss of sodium rapidly shortens lamp life.

SUMMARY OF THE INVENTION

Thus, there is a need for providing a heater for pre-start heating of a metal halide lamp, which avoids the photoelectron problem. An exemplary embodiment of the invention provides a metal halide gas discharge lamp, comprising an arc tube containing a vaporizable metal halide and first and second spaced electrodes. An arrangement for heating the arc tube assists in creating an arc discharge between the first and second electrodes. It comprises a heat source positioned to heat the arc tube, and an electron barrier disposed between the heat source and the arc tube for minimizing accumulation of photoelectrons on an outer surface of the arc tube so as to substantially avoid sodium migration out of the arc tube. A switch deactivates the heat source after the arc tube is heated a desired amount.

DESCRIPTION OF THE INVENTION

Figure 1:
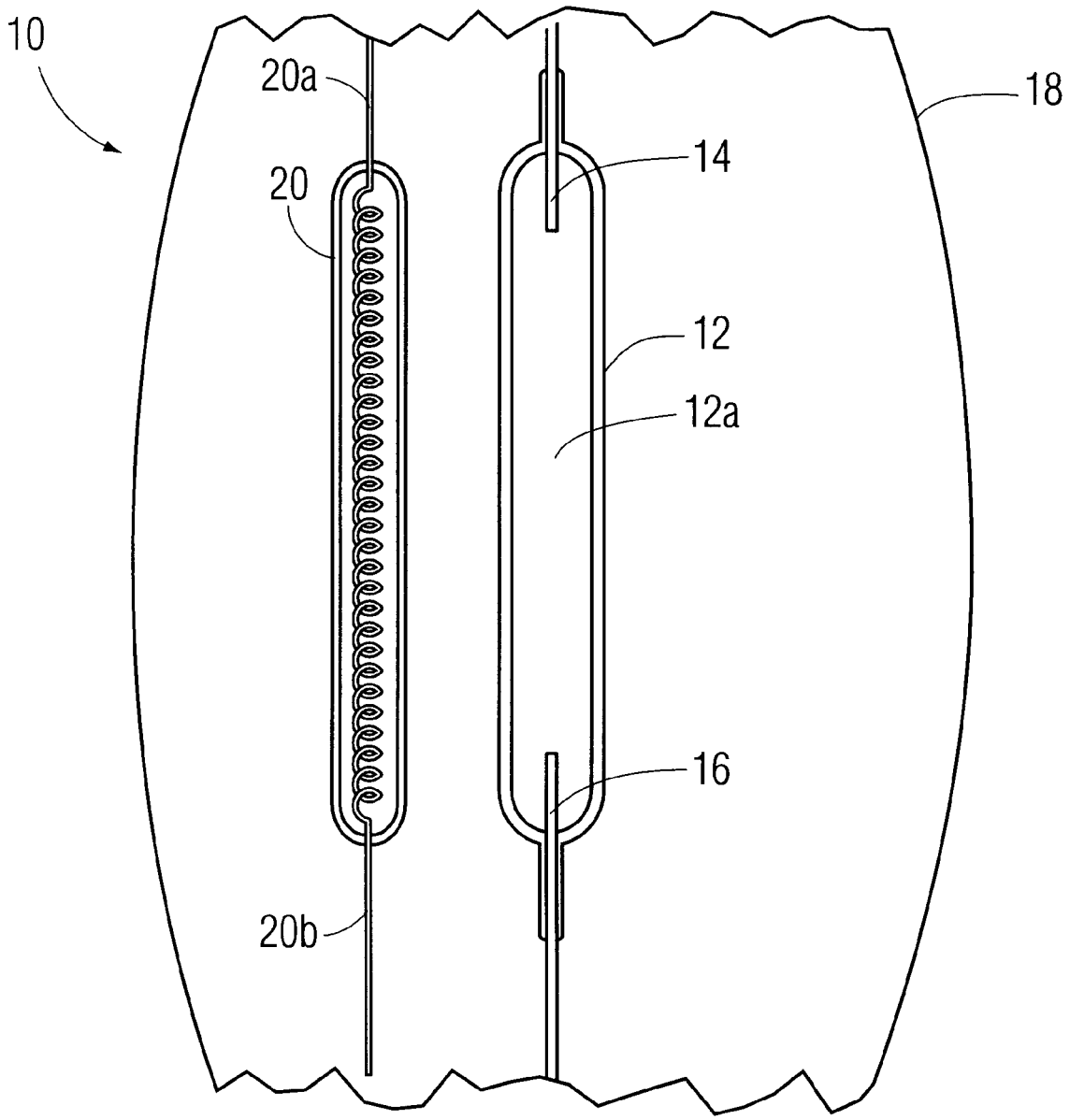
FIG. 1 is a simplified view of selected portions of a metal halide gas discharge lamp incorporating a pre-start heater.

FIG. 1 shows a selected portion of a metal halide gas discharge lamp 10 incorporating an arc tube 14 with an internal cavity 12*a*. Electrodes 14 and 16 are spaced apart within cavity 12*a*, which also contains (not shown) vaporizable material including a metal halide and mercury. Arc tube 12 is enclosed within an outer light-transmissive, vitreous envelope 18, such as quartz or glass. Supporting structure for the arc tube is conventional, and, for clarity, has been omitted from FIG. 1.

In accordance with an aspect of the invention, a heat source 20 is situated adjacent arc tube 12, within envelope 18, so as to heat the arc tube prior to attempting to strike an arc between electrodes 14 and 16. Heat source 20 may comprise, as shown, a dual-ended quartz filament-type incandescent lamp with in-lead 20*a* at one end and in-lead 20*b* at the other end.

To avoid the mentioned photoelectron effect, the quartz jacket of heat source 20 serves as a barrier to electrons for minimizing accumulation of photoelectrons on an outer surface of arc tube 12 so as to substantially avoid the deleterious photoelectron effect. In this connection, in-leads 20*a* and 20*b* of heat source 20 are preferably positioned distal from an arc (not shown) between electrodes 14 and 16 of the arc tube, so as to minimize the number of energetic photons reaching the in-leads from such an arc, and thereby reduce the resultant accumulation of photoelectrons on the outer wall of the arc tube. Alternatively, an electron barrier (not shown) could be provided between in-leads 20*a* and 20*b* and the arc tube.

Figure 2:
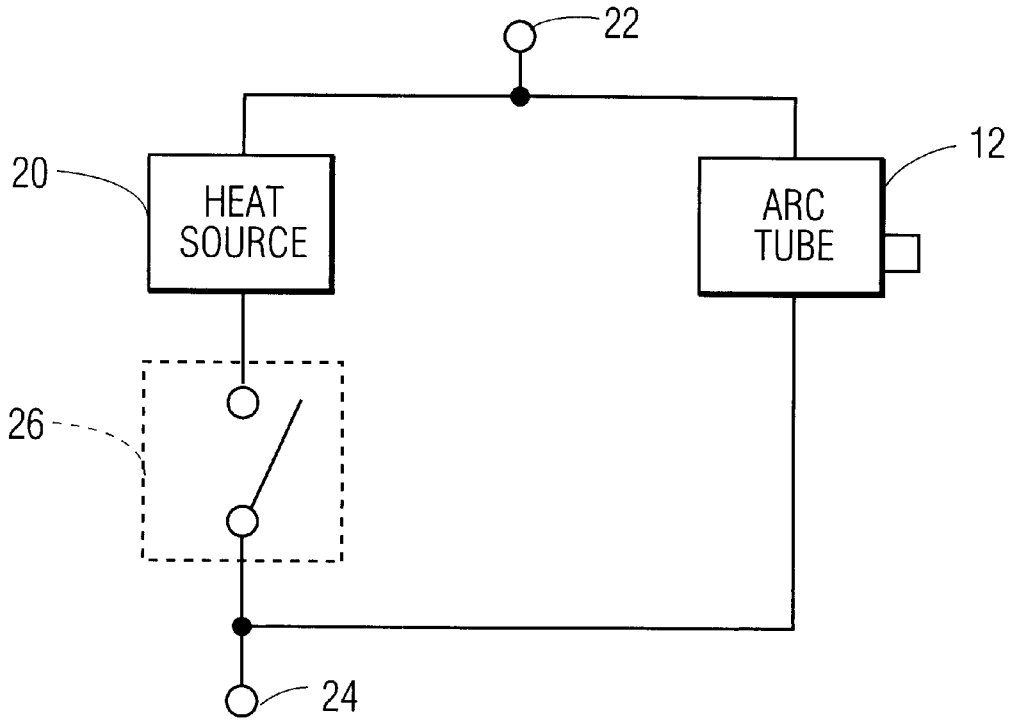
FIG. 2 is a schematic diagram, partially in block form, of circuitry for powering the heat source and arc tube of FIG. 1.

FIG. 2 shows circuitry for connecting main power nodes 22 and 24 to heat source 20 and arc tube 12 of FIG. 1. In the figure, arc tube 12 is permanently connected to the main power nodes, while heat source 20 is selectively connected to the power nodes via a single-pole switch 26.

Figure 3:
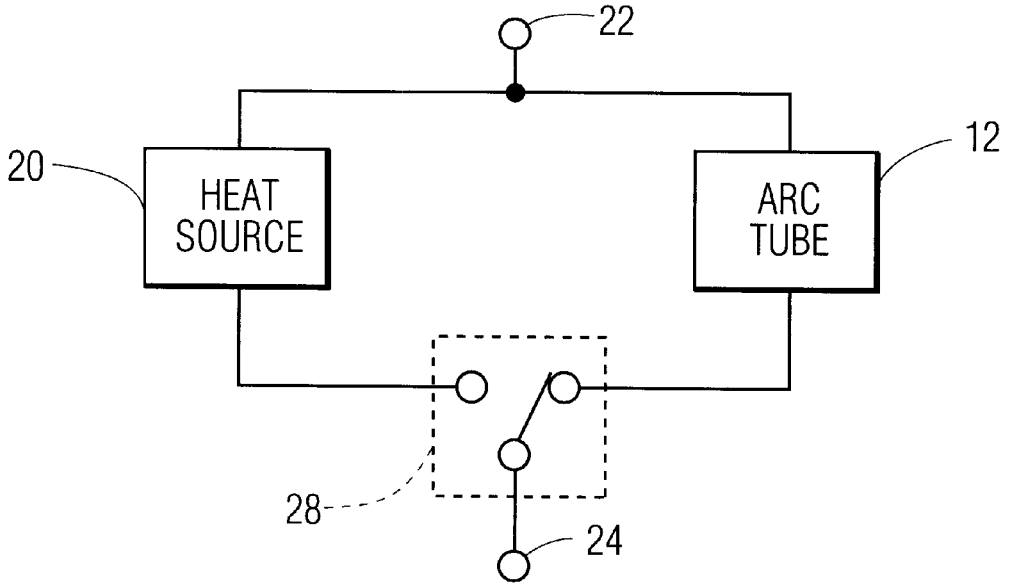
FIG. 3 is a schematic diagram, partially in block form, of alternative circuitry for powering the heat source and arc tube of FIG. 1.

FIG. 3 shows different circuitry for connecting the main power nodes alternately to heat source 20 and to main arc tube 12. This is carried out by a double-pole switch 28, which alternately connects main power node 24 to the heat source or to the arc tube.

Figure 4:
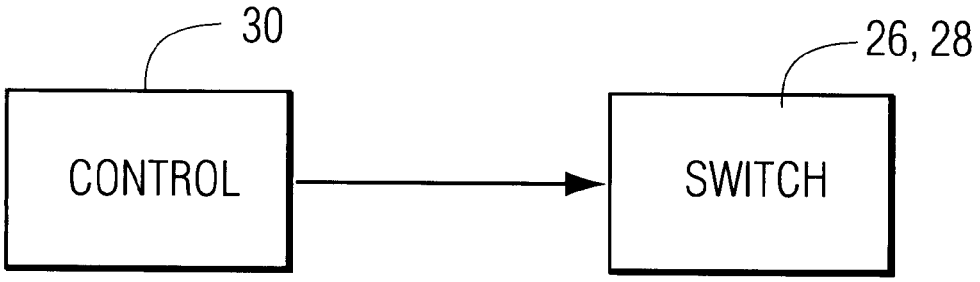
FIG. 4 is a schematic diagram in block form of a control block for the switch of either FIG. 2 or FIG. 3.
Figure 5:
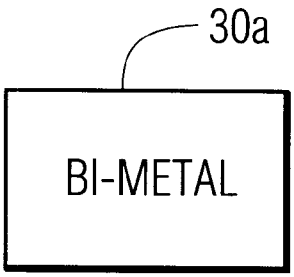
FIGS. 5 and 6 are block diagrams of alternative controls for the switches of FIG. 2 or FIG. 3.
Figure 6:
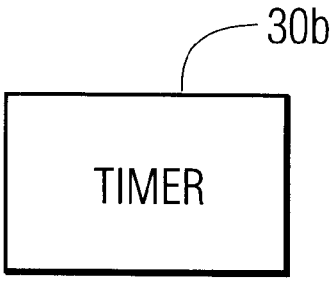

As shown in FIG. 4, a control block 30 controls operation of switch 26 (FIG. 2) or switch 28 (FIG. 3). A preferred control is a bi-metal switch, as shown at 30*a* in FIG. 5, placed within envelope 18 in FIG. 1. Such a switch is normally closed at ambient temperature, but opens when heated past a predetermined threshold. Such threshold is chosen to assure adequate heating (discussed below) of the arc tube. An alternative implementation is the use of a timer circuit 30*b* as shown in FIG. 6, which can be designed to disconnect the heat source from the main power nodes after a predetermined time during which adequate heating of the arc tube occurs.

As indicated by considerable experimentation with starting metal halide lamps at elevated temperatures, it is preferred that the lamp arc tube be heated prior to attempting to strike an arc in the arc tube until the partial pressure of mercury reaches at least 10 Torr, and preferably 25 Torr. The pressure can be calculated from the temperature and other parameters of the arc tube. Alternately, it is preferred that the coldest spot on the arc tube have a temperature prior to attempting to strike an arc in the arc tube of at least about 100° C. and more preferably 140° C. and still more preferably at least about 180° C.

Figure 7:
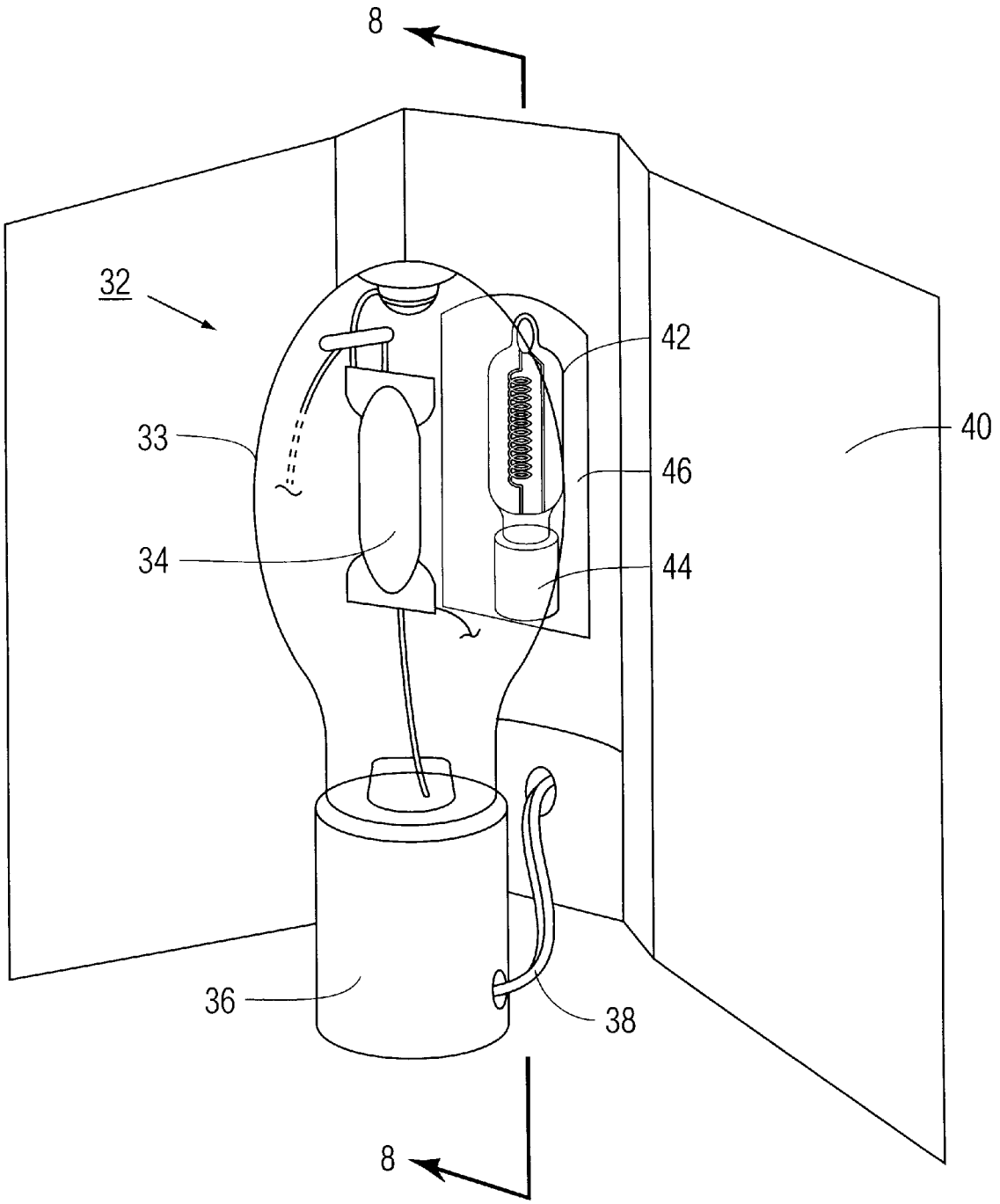
FIG. 7 is a simplified perspective view of a metal halide lamp and associated reflector, together with a filament-type incandescent lamp and associated reflector used as a heat source for the arc tube of the metal halide lamp.

FIG. 7 is a perspective view of a metal halide lamp and associated reflector, together with a filament-type incandescent lamp and associated reflector used as a heat source for the arc tube of the metal halide lamp. As shown in the figure, a metal halide lamp 32 includes an arc tube 34, an outer vitreous envelope 33, a base 36, and power leads 38. Conventional supporting structure for the arc tube is omitted for sake of clarity. A reflector 40 is associated with lamp 32 for focussing light from the lamp onto a desired work area. Additionally, a source of radiant heat, such as a single-ended quartz lamp 42 and base 44, are mounted within a reflector 46 whose primary focus is arc tube 34. Reflector 46 is preferably attached contiguously to reflector 40, for simplicity of design.

Figure 8:
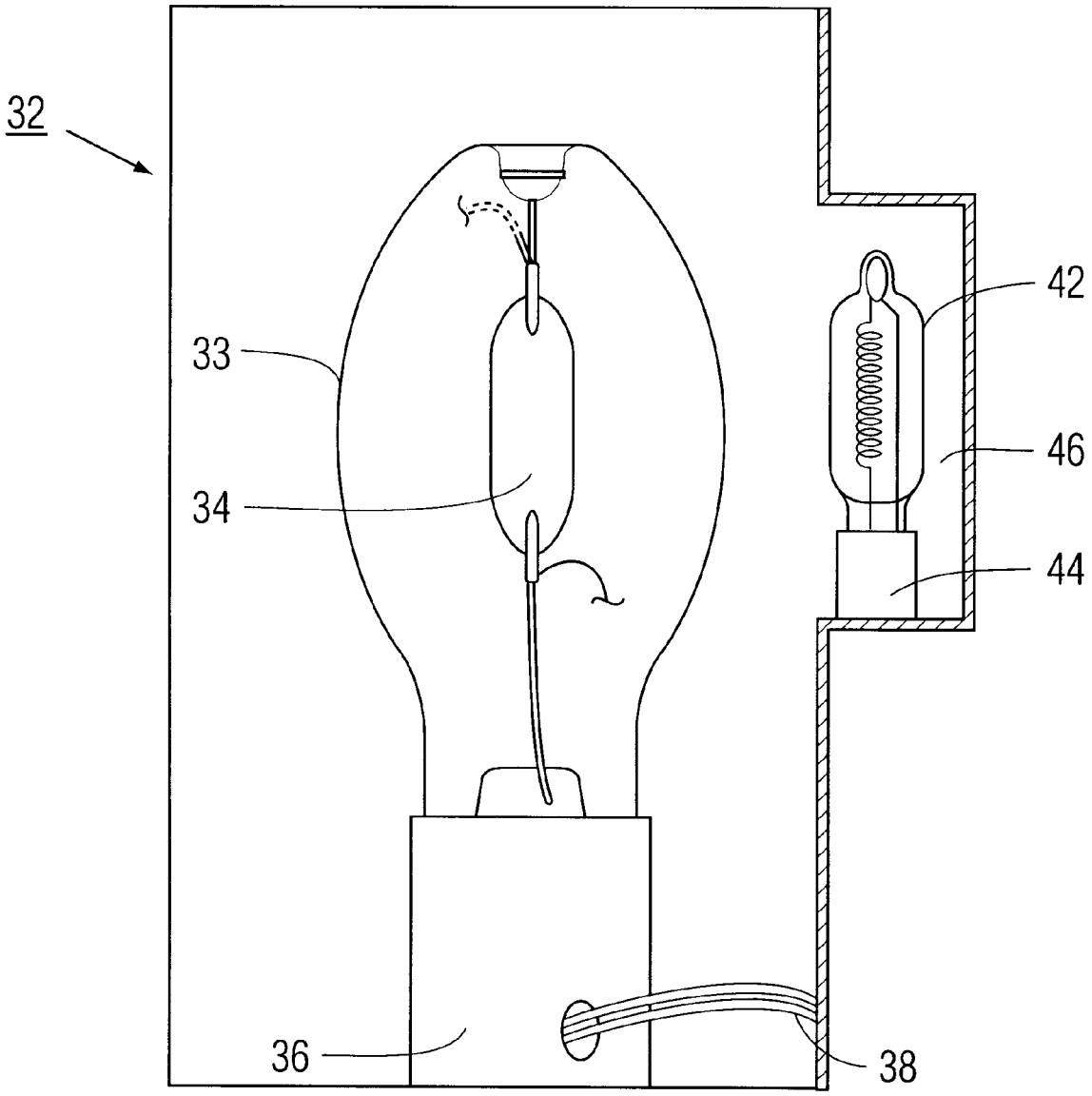
FIG. 8 is a cross-sectional view of the assembly of FIG. 7 taken at lines 8—8 in FIG. 7.

FIG. 8 more particularly shows a preferred shape of reflector 46 for directing radiant heat from lamp 42 onto arc tube 34. Reflector 46 may be generally elliptical in shape with one focus on the filament of lamp 42 and the other on arc tube 34. In this way, heat energy from lamp 42, as shown for instance by ray traces 48, is primarily focussed on the arc tube.

In the foregoing embodiment of FIGS. 7 and 8, outer vitreous envelope 33 serves as an electron barrier to minimize the mentioned photoelectron effect. The quartz material of heat source lamp 42 additionally serves as an electron barrier, and could obviate the need for the use of the vitreous envelope as an electron barrier. Therefore, a double-ended metal halide lamp 34, without envelope 33, could be used in conjunction, for instance, with heat source lamp 42.

As described above, double-ended or single-ended filament-type quartz lamps can be used to implement the heat source of the invention. More broadly, any suitable heat source can be used, such as a gas discharge lamp, as long as a suitable barrier to electrons is provided between the heat source and arc tube to minimize accumulation of photoelectrons on an outer surface of the arc tube so as to substantially avoid the photoelectron effect.

Beneficially, metal halide lights are often used in industrial settings or for outdoor lighting where the moment of start-up of the lamp is not critical. In such applications, waiting usually below about 10 minutes (depending on lamp design) for heating the arc tube will be tolerable. Moreover, where the heat source provides visible radiant energy (i.e., light), the heat source can serve as an immediate source of light while the arc tube is being heated.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A metal halide gas discharge lamp, comprising:

(a) an arc tube containing a vaporizable metal halide and first and second spaced electrodes;

(b) an arrangement for heating said arc tube to assist in creating an arc discharge between said first and second electrodes, comprising:

(i) a heat source positioned to heat said arc tube;

(ii) an electron barrier disposed between said heat source and said arc tube for minimizing accumulation of photoelectrons on an outer surface of said arc tube so as to substantially avoid sodium migration out of the arc tube; and (c) a switch for deactivating said heat source after said arc tube is heated a predetermined amount.

2. The lamp of claim 1, wherein:

(a) said vaporizable metal includes mercury; and (b) said desired amount of heating of said arc tube is heating until the partial pressure of mercury within said arc tube is at least about 10 Torr.

3. The lamp of claim 2, wherein said predetermined amount of heating of said arc tube is heating until the partial pressure of mercury within said arc tube is at least about 25 Torr.

4. The lamp of claim 1, wherein said predetermined amount of heating of said arc tube is heating until the cold spot temperature of said arc tube is at least about 180 degrees Centigrade.

5. The lamp of claim 1, wherein said heat source comprises a filament-type incandescent lamp.

6. The lamp of claim 1, where said heat source comprises a source of light for providing immediate light before start-up of light generation from said arc tube.

7. A metal halide gas discharge lamp, comprising:

(a) an arc tube containing a vaporizable metal halide and first and second spaced electrodes;

(b) a main reflector arranged to focus light from said arc tube onto an area distal from said lamp desired to be illuminated;

(c) an arrangement for heating said arc tube to assist in creating an arc discharge between said first and second electrodes, comprising:

(i) a heat source positioned to heat said arc tube;

(ii) an auxiliary reflector arranged to focus light from said heat source primarily onto said arc tube; and (iii) an electron barrier disposed between said heat source and said arc tube for minimizing accumulation of photoelectrons on an outer surface of said arc tube so as to substantially avoid sodium migration out of the arc tube; and (d) a switch for deactivating said heat source after said arc tube is heated a predetermined amount.

8. The lamp of claim 7, wherein said auxiliary reflector is attached contiguously to said main reflector.

9. The lamp of claim 7, wherein:

(a) said vaporizable metal includes mercury; and (b) said desired amount of heating of said arc tube is heating until the partial pressure of mercury within said arc tube is at least about 10 Torr.

10. The lamp of claim 9, wherein said predetermined amount of heating of said arc tube is heating until the partial pressure of mercury within said arc tube is at least about 25 Torr.

11. The lamp of claim 7, wherein said predetermined amount of heating of said arc tube is heating until the cold spot temperature of said arc tube is at least about 180 degrees Centigrade.

12. The lamp of claim 7, wherein said heat source comprises a filament-type incandescent lamp.

13. The lamp of claim 7, where said heat source comprises a source of light for providing immediate light before start-up of light generation from said arc tube.

* * * * *